United States Patent [19]

Cattell et al.

[11] 4,081,020

[45] Mar. 28, 1978

[54] MOULD ASSEMBLIES FOR USE IN CASTING MOLTEN METALS

[75] Inventors: Kerry Arthur Cattell; Roy Spencer Moore; Jim Pearce, all of Padstow, New Southwales, Australia

[73] Assignee: Foseco International Limited, Birmingham, England

[21] Appl. No.: 712,581

[22] Filed: Aug. 6, 1976

[30] Foreign Application Priority Data

Aug. 8, 1975 Australia ..... PC2696

[51] Int. Cl.[2] ..... B22D 23/02

[52] U.S. Cl. ..... 164/122; 249/106; 249/174; 249/197

[58] Field of Search ..... 249/106, 197–202, 249/170, 174, 129, 131; 164/122

[56] References Cited

U.S. PATENT DOCUMENTS

| | | | |
|---|---|---|---|
| 186,023 | 1/1877 | Sprague | 249/129 |
| 503,667 | 8/1893 | Mowry | 249/129 X |
| 1,666,759 | 4/1928 | Turner | 249/197 |
| 3,092,883 | 6/1963 | Ednell | 249/199 |

FOREIGN PATENT DOCUMENTS

| | | | |
|---|---|---|---|
| 1,057,231 | 2/1967 | United Kingdom | 249/129 |

*Primary Examiner*—J. Howard Flint, Jr.
*Attorney, Agent, or Firm*—Cushman, Darby & Cushman

[57] ABSTRACT

A mould assembly for casting molten metal which comprises a book mould, the upper parts of the walls of the upwardly open cavity of which are lined with hot top lining material and wherein extending across the width of the cavity there are one or more bridges of hot top lining material maintaining the hop top lining material along the longer walls of the cavity in contact with those longer walls.

7 Claims, 3 Drawing Figures

MOULD ASSEMBLIES FOR USE IN CASTING MOLTEN METALS

This invention relates to mould assemblies for use in casting molten metals.

It is well known to cast molten metal into ingots, slabs or billets prior to further processing such as rolling. If a simple mould is used for such casting, the metal at the open top of the mold tends to solidify first and because of the shrinkage of the molten metal as it solidifies, defects such as cracks, fissures and cavities appear in the body of the cast metal. In order to avoid such defects, it is customary to reduce the rate of heat loss from the molten metal at the top of the mould immediately after casting so that this so-called head metal acts as a reservoir of molten metal which feeds downwardly as solidification progresses to compensate for shrinkage. The head metal may be kept molten either simply by surrounding it with a lining of thermally insulating material or by supplying heat to the head metal, e.g. by surrounding it with a lining wholly or partly of a material which, when contacted by molten metal, fires exothermically positively to supply heat to the head metal.

Such techniques, known generally as hot topping, are widespread in the casting of steel ingots but analogous techniques are known and practiced in the casting of ingots of other metals and alloys, both ferrous and non-ferrous.

In order to constitute a so-called hot top lining for use in the method of casting just noted, it is common practice to take a plurality of generally rectangular slabs and fix them in position in the head of an ingot mould, usually by nailing, wedging, clipping or the like. Such techniques are easy to use in the case of large scale ingot moulds e.g. as used in steelworks, but are very difficult to use in the case of book moulds.

Book moulds are used for casting relatively small slabs and billets. They are chiefly used in the non-ferrous metal industries, e.g. for casting coinage and bullion metals, though their use is naturally not so restricted and indeed they may be used for casting both ferrous and non-ferrous metal and alloy types. Book moulds consist of two mould halves usually of equal size which are hinged together along one edge and which can be held together by appropriate fastening means to define between them an upwardly open casting cavity. The hinge line between the two halves may be horizontal or vertical, and the mould may have additional cooling means such as a water-cooling jacket. The moulds have the general shape of a rectangular parallel-piped and the proportions of a book and the upwardly open cavity accordingly terminates in a rectangular aperture the length of which may be several times greater than its width e.g. more than 6 times greater. If an attempt is made to line the head of a book mould, i.e. to line the walls of the long rectangular cavity, with slabs of hot top lining material by wedging these slabs into place in known fashion, there is a tendency for the slabs along the longer walls of the rectangular cavity to bow away from those walls. When the book mould is filled with molten metal, this metal can accordingly penetrate behind the slabs which severely disrupts the desired heat insulation or exothermic effects and which additionally leads to the inclusion in the cast head metal of the residue of the hot top lining slab. This is undesirable.

According to the present invention there is provided a mould assembly for casting molten metal which comprises a book mould, the upper parts of the walls of the upwardly open cavity of which are lined with hot top lining material and wherein extending across the width of the cavity there are one or more bridges of hot top lining material maintaining the hot top lining material along the longer wall of the cavity in contact with those longer walls.

The hot top lining and bridges may be of a refractory heat insulating material of known type or they may be made of an exothermically reacting material. Preferred materials are those formed of bonded highly refractory fibres, for example alumino-silicate fibres bonded with synthetic resin, alkali metal silicate or colloidal oxide hydrosol binders.

The hot top lining assembly, including the parts lining the walls and the bridging parts, may be made of a single material throughout or of different materials, and may be made in one piece or as a number of sections which are assembled together to form the whole. If the lining and bridges are formed of a plurality of pieces these may be jointed together by simple butt joints or by joint configurations such as mortice and tenon, tongue and groove or dovetail joints. If the hot top lining is made of a plurality of lining slabs, these may each be homogeneous or may themselves be multilayer materials.

The exact configuration of the hot top lining and bridges will vary considerably with the particular book mould in question. The lining on the walls will usually extend from the top of the book mould a short distance downwardly but the lining may extend a short way above the top of the walls of the book mould and may for example consist of a plurality of slabs each of which bears a flange adapted to rest on the top of the slab mould so locating the lining at a predetermined height relative to the top of the mould. A one-piece unit of wall lining and bridges may also have an external flange or shoulder for like purpose.

In order to allow ease of fitting of the lining and bridges into the top of the cavity of the mould, the materials of which they are made should preferably have a certain compressibility and resilience. The bonded refractory fibrous compositions referred to above generally have such properties.

The assembly according to the invention has a plurality of pouring apertures at the top of the mould and molten metal is poured through one of these during casting. The most preferred configuration is that including two bridges spaced roughly $\frac{1}{3}$ and $\frac{2}{3}$ of the way along the longer walls, thus forming three pouring apertures.

The invention is illustrated by way of example with reference to the accompanying drawings, in which.

Figure 1:
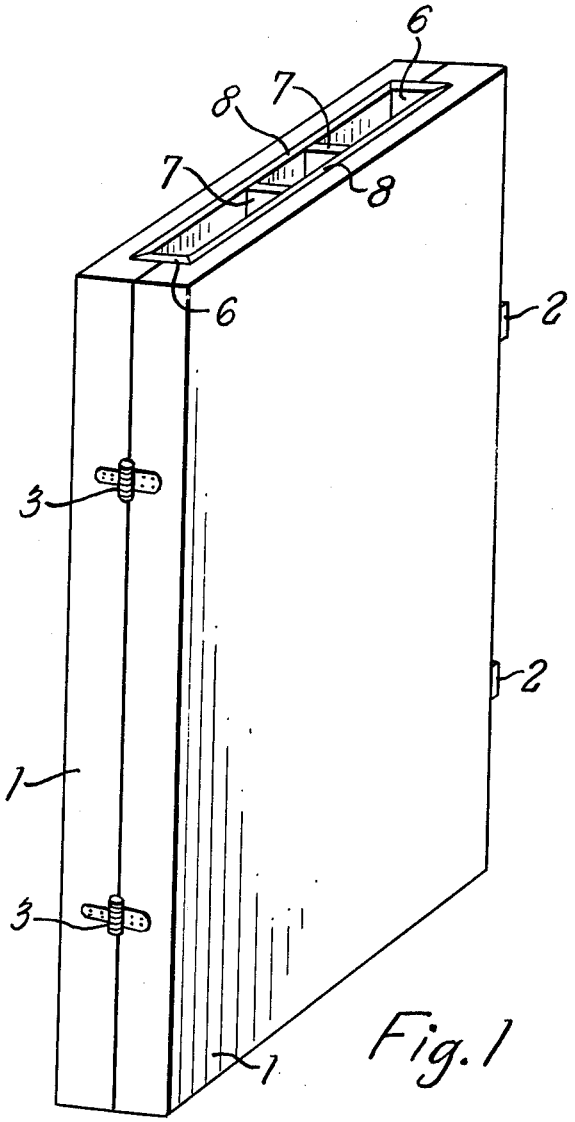
FIG. 1 is a perspective view of a mould assembly according to the present invention.

Referring to FIG. 1, the book mould consists of two mould halves 1 hinged together by hinges 3 along one side and fastenable together along the opposite side by means of two fasteners 2.

Located in the upper end of the mould cavity is a hot top lining made of two end slabs 6, two side slabs 8, and two bridging slabs 7. Each of slabs 6, 7 and 8 are made of refractory heat insulating material and they are so sized that on insertion into the cavity of the mould as shown in FIG. 1, they are held compressed.

Figure 2:
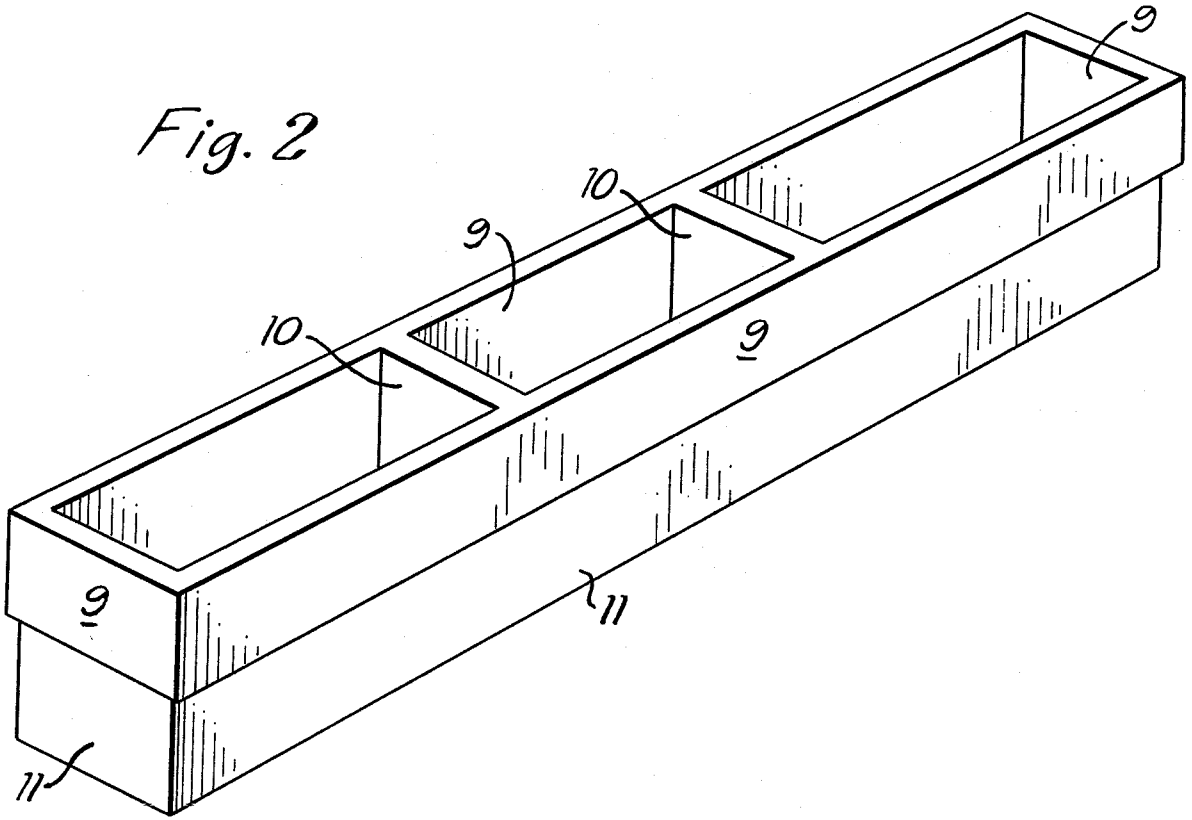
FIG. 2 is a perspective view of a hot top lining unit for use in the present invention.

The hot top lining unit shown in FIG. 2 is formed integrally and comprises four exterior walls 9 and two internal bridging walls 10. Modes of manufacturing lining units of this nature are well known and include, for example, hand ramming or jolt squeezing an appropriate heat insulating composition into the cavity of a wooden or plastics mould of appropriate shape, allowing the composition to cure or harden to self-supporting form and then removing the shape from the mould and allowing it to dry or finish hardening. The exterior walls 9 shown in FIG. 2 do not extend the full thickness shown all the way towards the bottom of the book mould. Rather they consist of a thicker upper section and a thinner lower section 11. Only the lower section fits into the top of the mould cavity.

Figure 3:
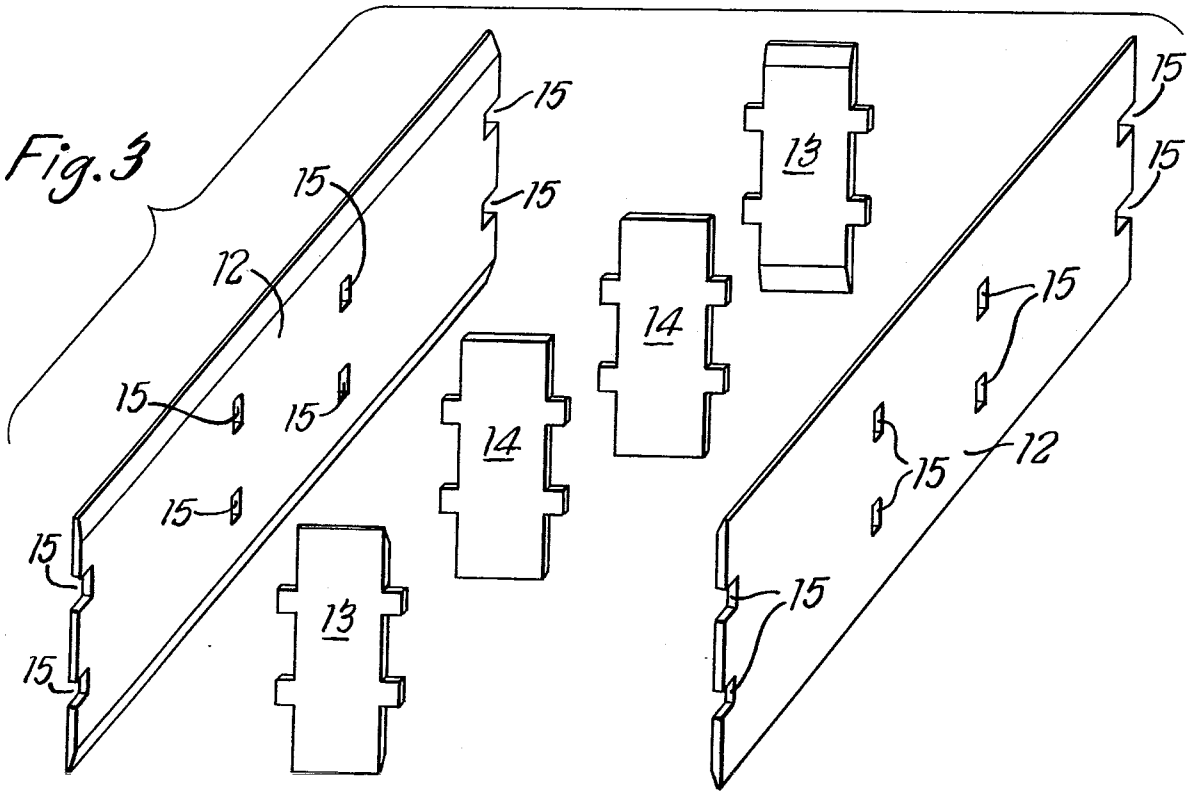
FIG. 3 is an exploded view of a set of slabs of heat insulating lining material for use in an assembly according to the present invention.

FIG. 3 shows an exploded view of two elongate side slabs 12, two end slabs 13 and two bridges 14 for a hot top lining assembly for use in a book mould according to the present invention. The projections on the slabs 13 and bridges 14 fit into apertures 15 in slabs 12.

The use of mould assemblies according to the present invention can enable the satisfactory use of hot top linings in book moulds leading to an increased yield of useful metal. In a comparison, using book moulds of internal cavity dimensions 170 × 32 × 4 cm, coinage alloys were poured, 190 kg of molten alloy being poured in each case. After solidification, stripping of the solidified metal from the mould and removing unusable metal by top cropping, the length of the slab obtained was measured. In three casts using no hot top lining the usable lengths of slab obtained were 129.5, 130.5 and 127.5 cm, an average usable length of 129 cm. When under identical conditions a hot top lining assembly as shown in FIG. 1 of the accompanying drawings was inserted, the slabs extending 15 cm from the top of the mould into the cavity, the usable lengths of three comparison cast slabs were 151.0, 150.6 and 152.0 cm, an average usable length of 151.2 cm, i.e. an improvement in the amount of usable metal of greater that 17%.

We claim:

1. A mould assembly for casting molten metal, comprising a book mould formed from two mould halves hinged together along one edge, and together defining an upwardly open continuous mould cavity of substantially rectangular cross-section with a length at least six times its width, means for holding the two halves together, and a hot top lining preformed of hot top lining material in contact with the walls of the head of the cavity and terminating short of the continuous moulding cavity defined by said mould halves, wherein the improvement comprises means for preventing bowing of the hot top lining material adjacent the longer walls of the cavity away from the longer walls so that substantially all of the hot top lining material adjacent the longer walls of the cavity is maintained in contact with those longer walls, said bow-preventing means comprising at least one bridge of hot top lining material spanning the width of the hot top intermediate the end walls thereof and having substantially the same height as the height of the hot top lining material.

2. The mould assembly of claim 1 wherein the hot top lining material is a refractory heat insulating material.

3. The mould assembly of claim 2 wherein the hot top lining material is a bonded refractory fibrous composition.

4. The mould assembly of claim 3 wherein the hot top lining material is aluminosilicate fibre bonded with a binder selected from the class consisting of synthetic resins, alkali metal silicates and colloidal oxide hydrsols.

5. The mould assembly of claim 1 wherein the hot top lining and the bridges are formed integrally.

6. The mould assembly of claim 1 wherein the hot top lining material along the walls of the cavity has a flange resting on the top of the book mould.

7. A method of casting molten metal by teeming molten metal into a book mould formed from two mould halves hinged together aong one edge and together defining an upwardly open continuous moulding cavity of substantially rectangular cross-section with a length at least six times its width, providing means to hold the two halves together during moulding, providing in the head of the book mould, terminating short of the continuous molding cavity, prior to the commencement of teeming, a hot top lining preformed of hot top lining material in contact with the walls of the head of the cavity, and allowing molten metal to solidify in the mould, the improvement comprising the step of preventing bowing of the hot top lining material adjacent the longer walls of the cavity away from the longer walls so that substantially all of the hot top lining material adjacent the longer walls in maintained in contact with those longer walls, by providing at least one bridge of hot top lining material spanning the width of the hot top lining intermediate the ends walls thereof and having a height substantially the same as the height of the hot top lining material.

* * * * *